United States Patent [19]

Welter et al.

[11] 4,263,487

[45] Apr. 21, 1981

[54] AIR SWITCH

[75] Inventors: Clarence L. Welter; Stephen R. Riggens, both of Birmingham, Ala.

[73] Assignee: Electrical Equipment, Inc., Birmingham, Ala.

[21] Appl. No.: 135,489

[22] Filed: Mar. 31, 1980

[51] Int. Cl.[3] ..... H01H 31/00

[52] U.S. Cl. ..... 200/48 KB; 200/153 SC

[58] Field of Search ..... 200/48 SB, 153 SC, 48 P, 200/48 KB, 154

[56] References Cited

U.S. PATENT DOCUMENTS

| | | | |
|---|---|---|---|
| 2,744,179 | 5/1956 | Schneider | 200/48 KB |
| 3,356,799 | 12/1967 | Ortwig et al. | 200/48 KB |
| 3,652,815 | 3/1972 | Davies | 200/153 SC |
| 3,875,360 | 4/1975 | Rys | 200/153 SC |
| 3,898,409 | 8/1975 | Liebig et al. | 200/153 SC |
| 4,139,747 | 2/1979 | Kelly | 200/48 KB |

FOREIGN PATENT DOCUMENTS

| | | | |
|---|---|---|---|
| 1097925 | 7/1955 | France | 200/48 KB |

*Primary Examiner*—Willis Little

*Attorney, Agent, or Firm*—Richard A. Zachar

[57] ABSTRACT

Load break air switch incorporating quick make and break mechanical operator that includes arming and load release levers rotatable about separate parallel axes. A pair of compression springs are connected in uni-directional force transmitting relation between the arming and load release levers and are respectively disposed on opposite sides of the plane defined by the foregoing axes. Latching structure is provided to prevent rotation of the load release lever upon rotation of the arming lever until a predetermined amount of energy is stored in one of the compression springs. Improved pivot structure is provided for providing enhanced current transfer, the pivot incorporating a louvered contact band.

3 Claims, 13 Drawing Figures

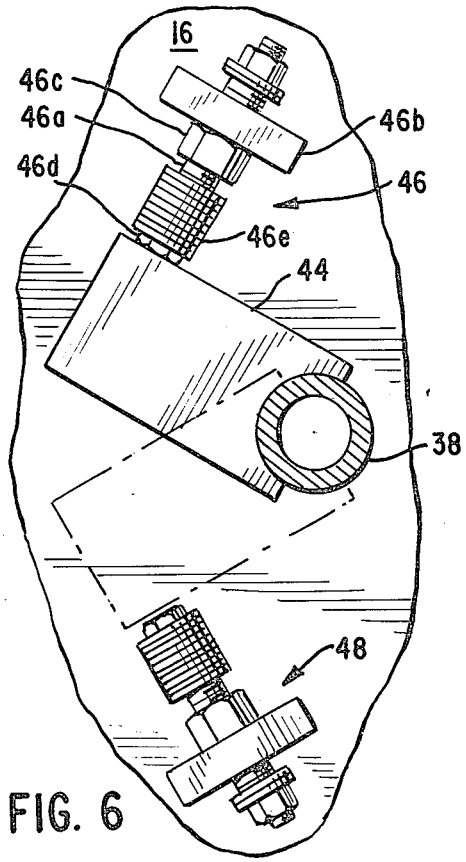
FIG. 6
FIG. 5a
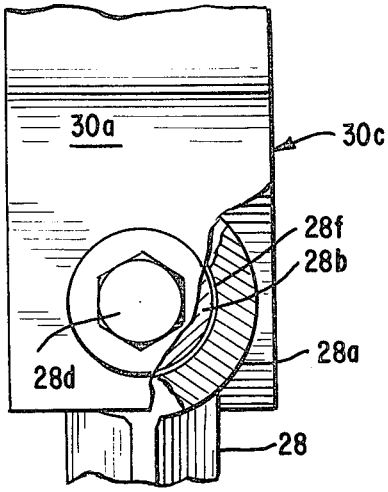
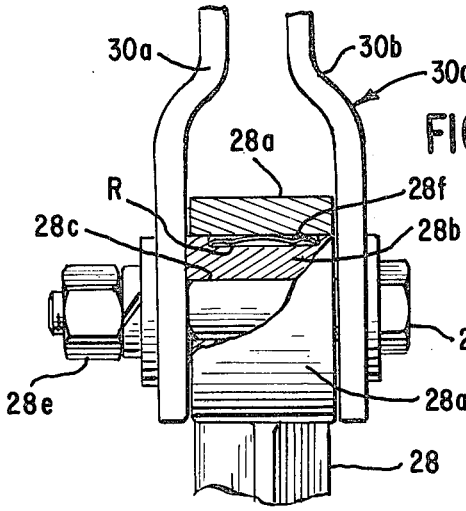
FIG. 5b
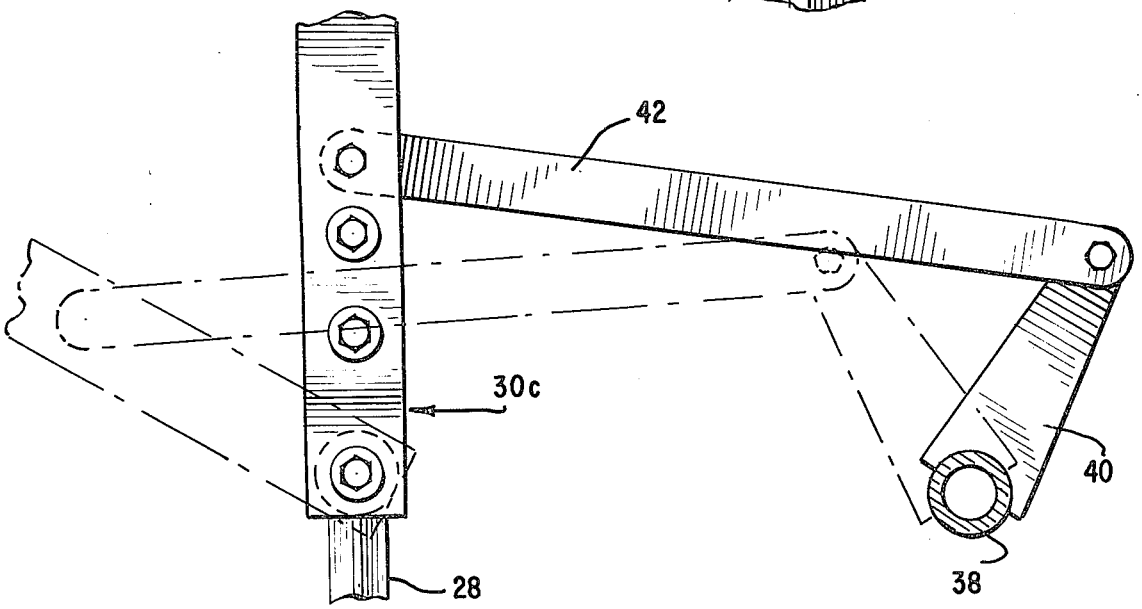
FIG. 7

AIR SWITCH

BACKGROUND OF THE INVENTION

The present invention relates to switching apparatus and, more particularly, to load break air switch apparatus for use in applications such as in terminating and sectionalizing electrical power distribution.

Although load break switch technology is well-developed, there is a constant need for improvement in the areas of operator safety, arc supression, cost-to-rating ratios, versatility of use and compactness.

In certain prior art systems the switchgear is housed within an oil filled tank. The oil afforded a more compact arrangement due to the increased dielectric strength of oil, as compared to air, thereby facilitating arc extinguishing. One such oil filled, load break switch is disclosed in U.S. Pat. No. 4,061,896. There are obvious drawbacks to oil filled switchgear apparatus and, as a result, the switchgear industry has attempted to overcome the design problems caused by arcing without resort to control of the ambient atmosphere surrounding the operating components of the switchgear. In recent years, numerous arc suppression techniques have been employed with varying degrees of success. One such system employs a piston-type arrangement for generating a blast of air to suppress the arc during contact disengagement. While such an arc interruptor arrangement has been found to be effective, its use introduces a number of design problems.

In respect to safety it is imperative that engagement and disengagement of the switch contacts be controlled independently of the action of the human operator (for the reasons discussed in the above-noted U.S. Pat. No. 4,061,896). To this end, so-called "quick make and break" mechanical operators have been developed. These mechanical operators incorporate energy storing systems (such as compression springs) responsive to the action of the human operator to store sufficient energy to cause contact engagement and disengagement at the proper speed regardless of the action of human operator. While the mechanical operator disclosed in U.S. Pat. No. 4,061,896 is capable of effective operation with the oil switch shown in that patent, the utilization of a blow-out type arc suppression device introduces additional mechanical power demands on the operator mechanism which can not be practically satisfied thereby, especially for multi-pole gang operated air switches.

Swtichgear of the type here involved typically incorporate movable contact blades requiring a pivot connection. Proper electrical current flow through the pivot is of course critical and heretofore such has provided problems of current transfer from the pivot rotating member to the pivot stationary member.

SUMMARY OF THE INVENTION

In accordance with the present invention a load break air switch incorporates a quick make and break mechanical operator system capable of storing sufficient energy to meet the mechanical power demands occasioned through use of piston type arc interruptor units, the operator including arming and load release levers mounted to rotate about separate, spaced apart, parallel axes, a pair of compression springs connected in unidirectional force transmitting relation between the arming and load release levers and respectively disposed on opposite sides of a plane defined by the aforementioned axes, and latching structure for preventing rotation of the load release lever upon rotation of the arming lever until a predetermined amount of energy is stored in one of the compression springs.

The load break switch incorporates a louvered contact band at the pivots of the movable contact blade assemblies to provide enhanced current transfer between the pivot rotating member and the pivot stationary member.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein:

FIGS. 5*a* and 5*b* are fragmentary side and front views showing details of the blade assembly pivot structure;

FIG. 6 is a view taken, as indicated, along the lines 6—6 of FIG. 4, showing the drive shaft rotation stop plate and open and close position bumper and support blocks;

FIG. 7 is a view taken, as indicated, along the lines 7—7 of FIG. 4, showing the insulated push-pull shaft and drive shaft lever arm connection to the blade assemblies;

DESCRIPTION OF THE PREFERRED EMBODIMENT

Figure 1:
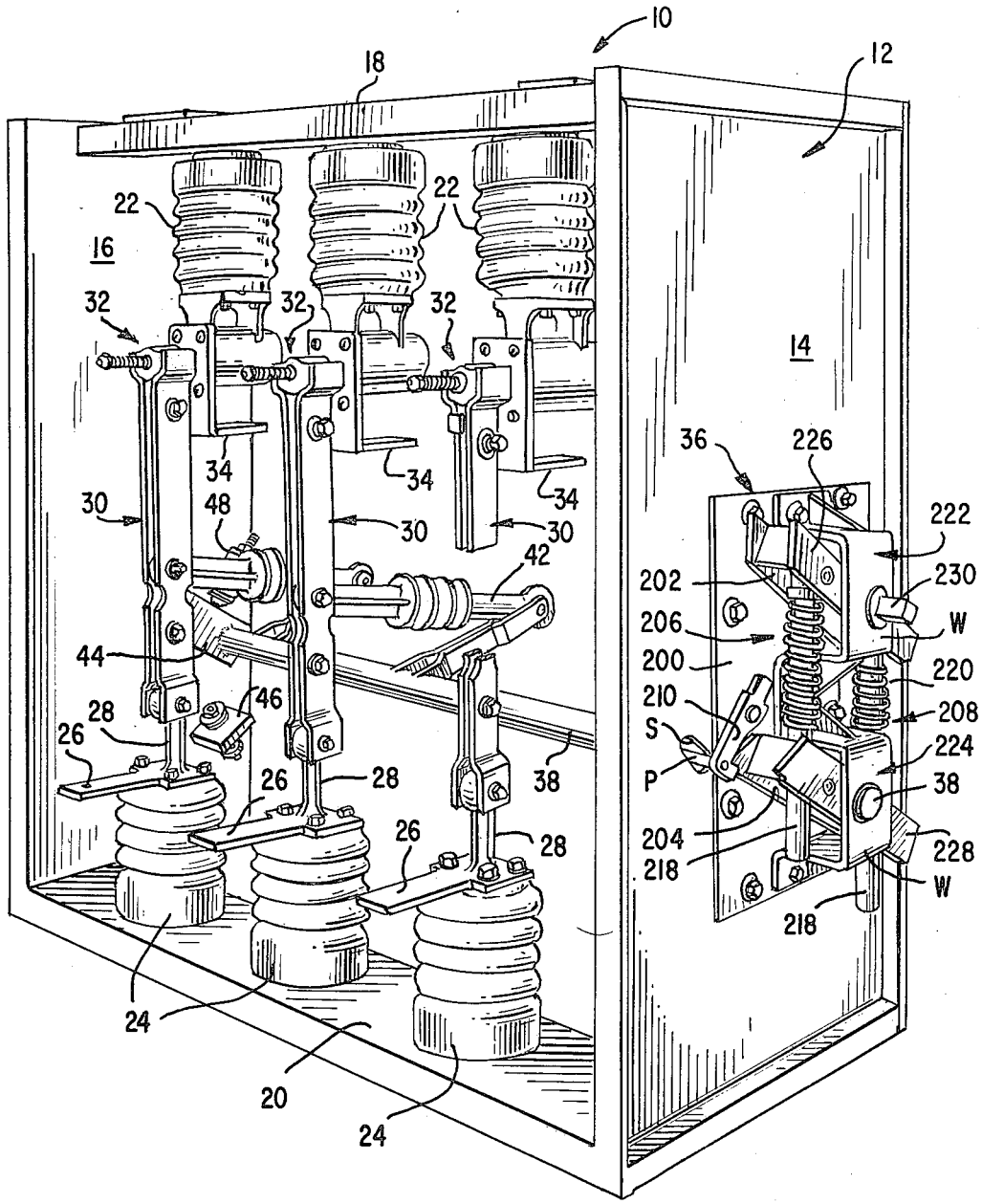
FIG. 1 is a front perspective view (with portions broken away for better illustration) of a three-pole gang operated air switch incorporating the present invention, the switch being shown in the "closed" position.
Figure 2:
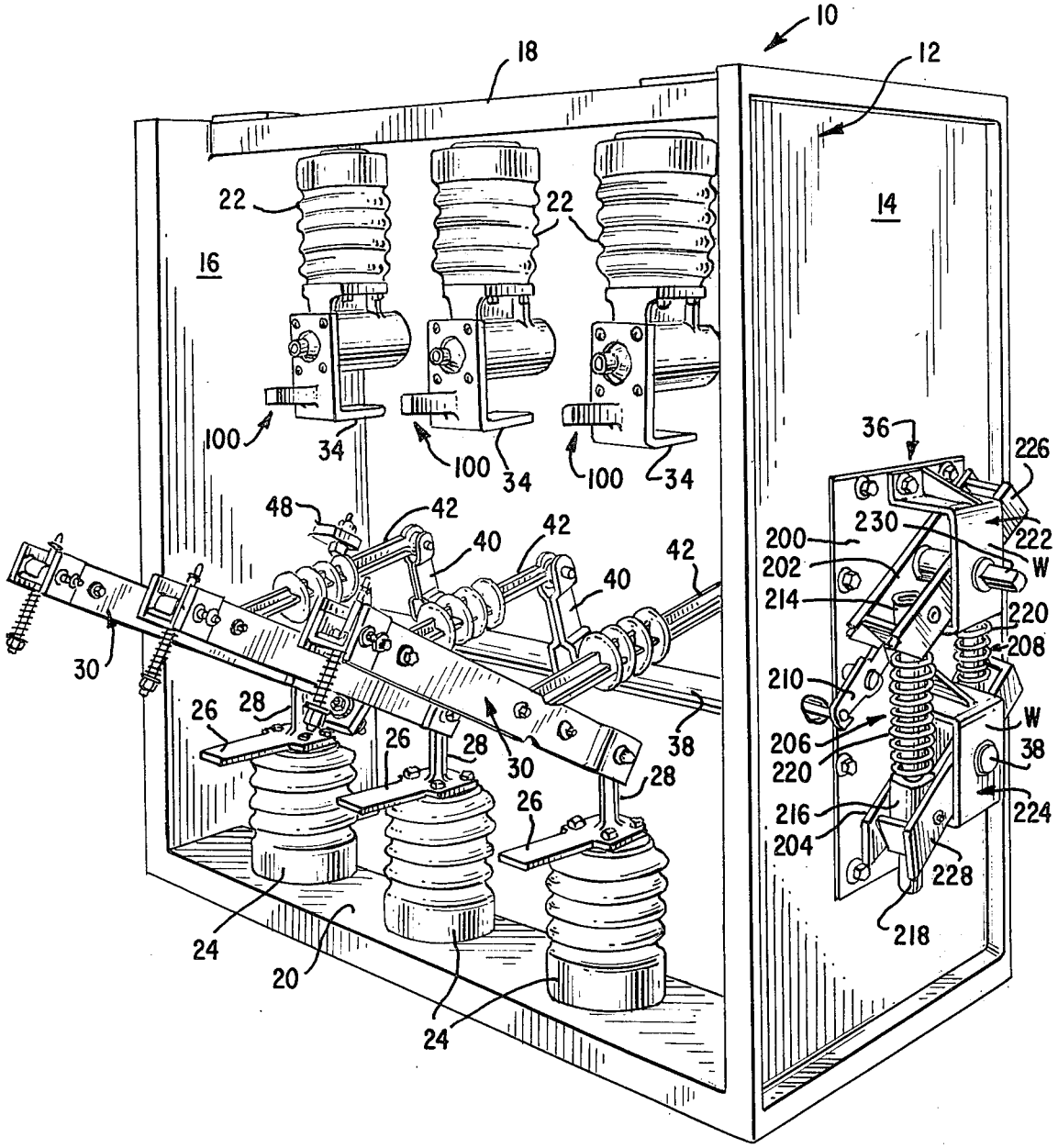
FIG. 2 is a view similar to FIG. 1 showing the switch in the "open" position.
Figure 4:
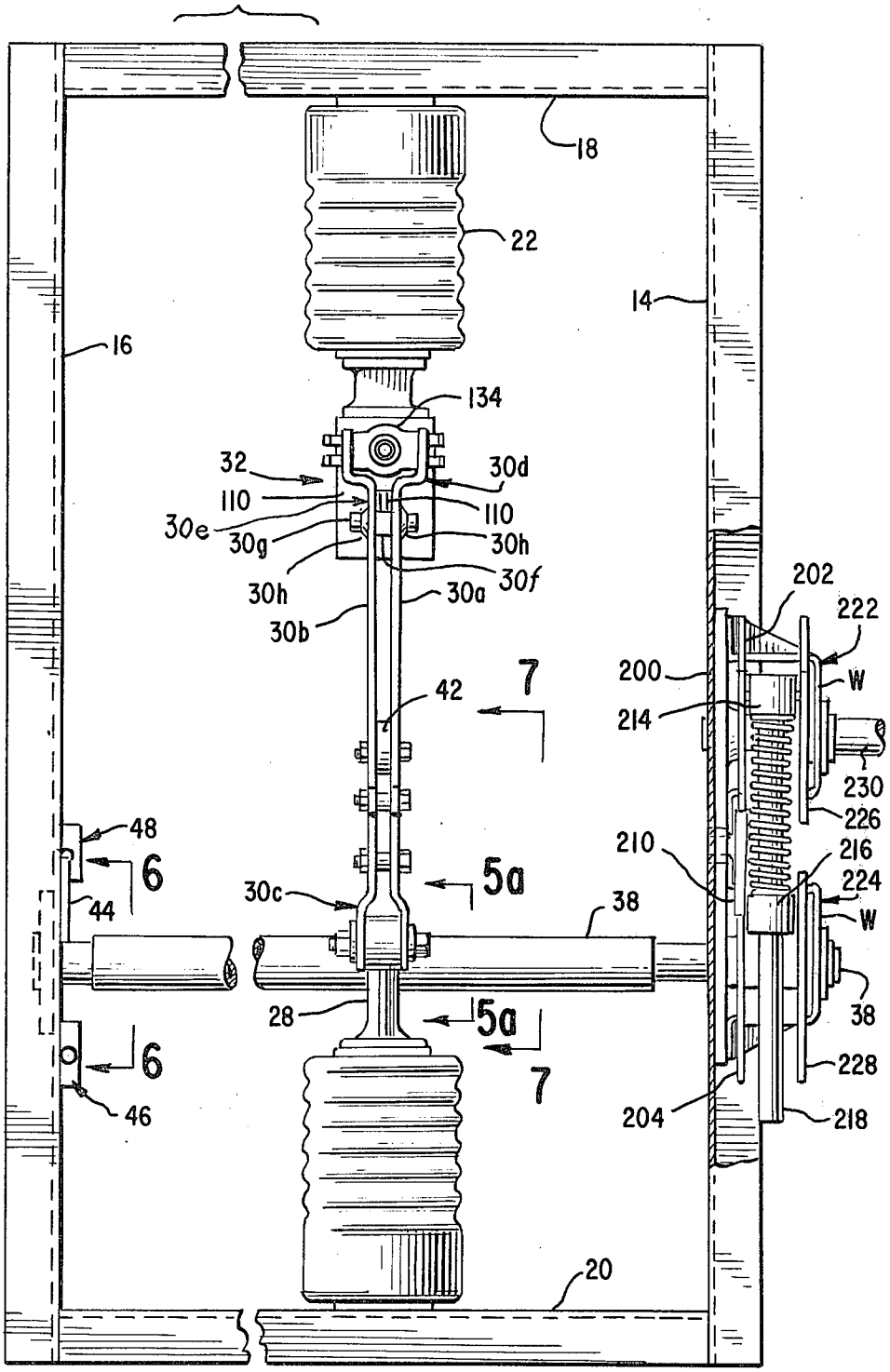
FIG. 4 is a front elevational view of the switch of FIGS. 1-3, the switch being broken as indicated to omit duplicate components.

Referrng now to the drawings and particularly to FIGS. 1, 2 and 4, the invention is shown for purposes of illustrative disclosure incorporated in a three-pole gang operated air switch assembly 10 supported by a carriage or frame unit 12. Frame 12 includes a pair of parallel-spaced side walls 14, 16, a top wall 18 and a bottom wall 20, all of which are suitably welded together to form a rigid frame structure. Normal current flow through the switch assembly occurs from the base termination pads 26, through the lower contact and blade supports 28, and into the blade assemblies 30 through the louvered contact band. The blade current is then transmitted to the main stationary contact assemblies 32 and out the upper termination pads 34.

The blade assemblies 30 are gang operated from the switch "closed" position illustrated in FIG. 1 to the switch "open" position illustrated in FIG. 2 by a means of mechanical operator 36 that imparts "quick make and break" contact between the blade assemblies 30 and contact assemblies 32. The switch assembly illustrated herein incorporates autopneumatic blow-out units as a part of the contact assemblies 32 which produce bursts of cooler deionizing air that disturbs and disperses any arc or ionized gas generated upon disengagement of the movable and stationary contacts of the contact assemblies 32.

As best shown in FIG. 4, the blade assemblies 30 each comprises a pair of blades 30*a*, 30*b* of electrically conductive material bolted in spaced relationship together. The blades 30*a*, 30*b* at the two opposed ends of the blade assemblies 30 fork outwardly from each other to define generally U-shaped lower and upper blade assembly end mounts 30*c*, 30*d* respectively.

Lower end mounts 30*c* are affixed to rotate relative to the lower contact blade supports 28 of conductive material such as 131 copper at the pivot structure best shown in FIGS. 5*a* and 5*b*. The blade supports 28 each include an integral, cylindrical end support 28*a* that is axially bored to receive a copper shaft 23*b* in journaled relation. The copper shafts 28*b* each are of an axial length slightly greater than that of the cylindrical end supports 28*a*, and are, in turn, axially bored to receive the shanks 28*c* of mounting bolts 28*d* that extend through axially aligned openings (not shown) of the spaced apart blades 30*a*, 30*b* forming end mounts 30*c*. With such arrangement the blades 30*a*, 30*b* are urged by nuts 28*e* into friction-locking engagement only with the opposed ends of shaft 28*b* which is free to rotate relative to the end supports 28*a*. The outer surface of each of the copper shafts 28*b* has an intermediate length radial recess R to accomodate a louvered contact band 28*f*.

The louvered contact band is a strip of conductive material, preferably of spring temper, punched with a close fitting series of louvers running perpendicular to the length of the strip. The length of the strip is sized to extend circumferentially about the upper shaft 28*b* within the recess R. In the illustrated embodiment (i.e., switch having a 600 amp continuous rating) the louvered contact band is a multilam band LAI a/0.15 rated at 25 A continuous per louver. In the illustrated embodiment, the louvered contact band is of beryllium copper material that has been silver-plated to negate corrosion. The multilam band incorporated herein is described in detail in the technical reports attached hereto as Appendices A and B, the contents of which reports are specifically incorporated herein by this reference. It will be appreciated that the louvers of the band provide a multiplicity of contact points between the bored surface of support 28*a* and the outside surface of shaft 28*b*. The height of the louvers and the gap between the board support 28*a* and shaft 28*b* in the region of the recess R are sized so that adequate contact pressure is obtained for normal load currents (i.e., 600 amp) when the pivot assembly is rotating or stationary. It will be noted that magnetic forces due to higher than normal current flow tends to rotate each louver toward a vertical position with respect to the band length thereby providing a higher contact pressure for fault current duty.

Upper blade assembly end mounts 30*d* are affixed to and support the probe sub-assembly of the blow-out arc interruptor units as will be later described.

The blade assemblies 30 each support a main movable contact sub-assembly 30*e* adjacent the corresponding upper end mount 30*d*. Main movable contact sub-assemblies 30*e* each include a centrally bored cylindrically-shaped spacer element 30*f* mounted by a bolt 30*g* to axially extend between the blades 30*a*, 30*b*. A pair of blade assembly flanking compression springs 30*h* normally bias the blades 30*a*, 30*b* tightly against the ends of spacer element 30*f* but permit outward flexure of the blades upon engagement thereof with the main stationary contact element 100, as will be described.

Figure 10:
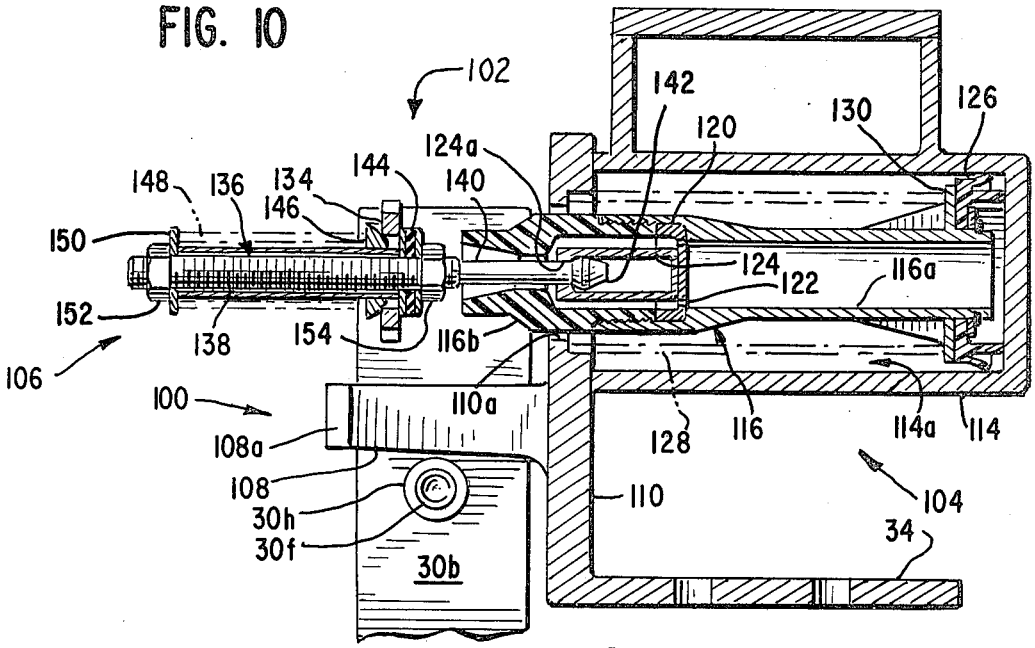
FIG. 10 is a detailed view showing the probe and puffer assemblies partially in section in the switch "closed" position.

Referring to FIG. 10, the contact assemblies 32 each include main stationary contact element 100 located below its corresponding blow-out arc interruptor unit 102 which, in turn, comprises a puffer sub-assembly 104 and a probe sub-assembly 106.

Each main stationary contact element 100 comprises a knife-like projection 108 integral with and projecting outwardly in a vertical plane from a mounting plate 110. Each upper termination pad 34 also integrally extends from the base of the corresponding plate 110 in a horizontal plane. The vertical free end 108*a* of the knife-like main stationary contact element 108 is bevelled to facilitate entry thereof between the spaced blades 30*a*, 30*b* of blade assemblies 30. In this regard the blades 30*a*, 30*b* are normally spaced apart a distance less than the thickness of contact element 108. In the illustrated embodiment, the blades are spaced 7/16 inch while element 108 is ½ inch thick. Stationary contact element 100 is of 131 copper.

Each puffer sub-assembly 104 is supported by mounting plate 110 above the corresponding upper termination pad 34, while each probe sub-assembly 106 is mounted to the corresponding upper end mount 30*d* of the blade assemblies 30. The function, structure and operation of the blow-out arc interruptor units of the type incorporated herein are known and, therefore, such will be only briefly described herein.

The puffer sub-assembly 104 includes a cylindrical housing 114 interiorly defining a cylinder chamber 114*a*. A puffer 116 of axially elongated, generally tube-like configuration is mounted in piston-like fashion within cylinder chamber 114*a* and extends at one end through an opening 110*a* in mounting plate 110. Puffer 116 includes a main body portion 116*a* connected in telescopic threaded engagement with a probe 116*d*. An insert cylinder element 120 that includes a circumambient opening 122 internally supports a tube-like probe receptacle 124 in co-axial alignment within the puffer with its outer walls in radially-spaced relationship to the inner walls of the probe guide portion 116*b*. At the end of the puffer 116, opposite the probe guide portion, there is mounted a piston cap and buffer mounting unit 126 of resilient material to form a seal between the walls of cylinder chamber 114*a* and the outer wall of the puffer 116. Completing the puffer sub-assembly, a puffer spring 128 is shown mounted to extend between radial puffer flange 130 located adjacent the piston cap and buffer mounting unit 126, and the mounting plate 110 which, in turn, has a spring receiving groove portion 132 for this purpose. As mentioned, the probe guide portion 116*b* extends through opening 110*a* provided in the mounting plate 118, the opening being of larger diameter than the outer diameter of the probe guide portion 116*b* in order to permit the puffer to pivot off axis during engagement and disengagement thereof with the probe sub-assembly.

Each probe sub-assembly 106 is supported by a mounting jacket 134 that is shown (see FIG. 4) bolted between the blades 30*a*, 30*b* at the upper end mount 30*d* of the corresponding blade assembly 30, and includes an axially elongated, shaft-like probe element 136 having a threaded length portion 138 and a probe plug end portion 140 terminating with a plug head 142 having an axially increasing radial diameter segment followed by axially decreasing radial diameter segment. The maximum radial diameter portion of the plug head 142 is slightly less than the minimum inner diameter portion of the probe guide 116*b* but is greater than the entry opening 124*a* of the probe receptacle 124. As illustrated, the entry 124*a* to receptacle 124 is of reduced diameter, as compared to the main interior length portion thereof, and is defined by an annular, rounded bead that inwardly extends from the inner wall thereof. As a result, a mechanical interference fit relationship exists between the probe plug head 142 and the receptacle 124. Plug head 142 and probe receptacle portion 124*a* are composed of high temperature arc resistant material such as copper tungsten.

Figure 11:
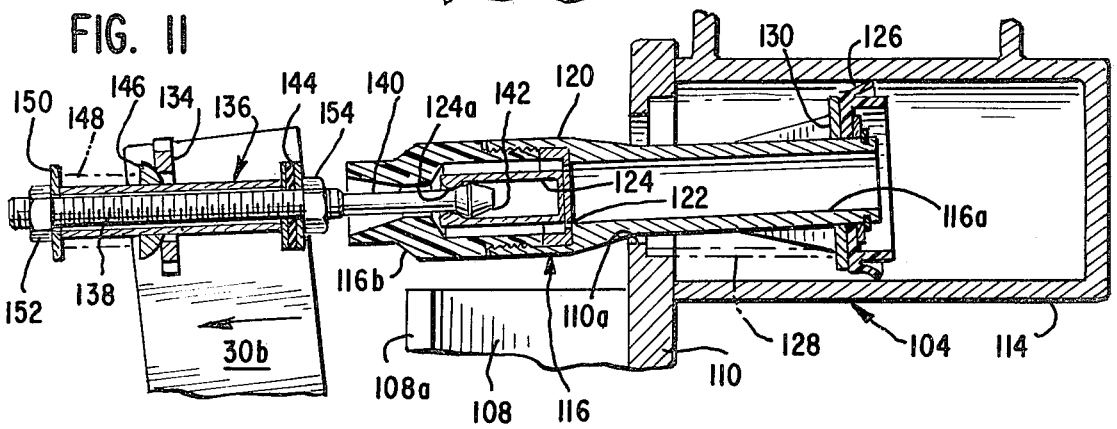
FIG. 11 is a fragmentary view similar to FIG. 10 showing the probe assembly retracting with the puffer assembly during the initiation of the switch "opening" action.

The probe element 136 is mounted to the mounting jacket 134 in a manner to afford slight axial deflection of the probe sub-assembly 106 about a point lying in the plane of the defined by the jacket 134. To this end mounting jacket 134 defines an opening through which the threaded length portion 138 of probe element 136 extends that is of greater diameter than the threaded portion 138. Mounting jacket 134 is oppositely engaged by a laminate washer assembly 144 and cam washer 146, respectively. A probe compression spring 148 is mounted to extend coaxially of the threaded length portion 138 between cam washer 146 and washer 150. Nuts 152 and 154 in threaded engagement with the threaded length portion 138 act in cooperation with spring 148 to apply forces tending to squeeze laminate washer 144 and cam washer 146 into tight engagement with mounting jacket 134. As will be explained, during engagement and disengagement of probe and puffer sub-assemblies, the probe element 136 is forced by the puffer guide 116*b* to pivot slightly. Such pivoting is permitted by virtue of the cammed engagement of cam washer 146 with the mounting jacket 134 as illustrated in FIG. 11.

With reference to FIGS. 1, 2, 4 and 7, the blade assemblies 30 are driven by common drive shaft 38 that extends between and is suitably journal mounted to the frame walls 14, 16. Rotary motion of drive shaft 38 is transmitted to the blade assemblies via arms 40 welded to the drive shaft and insulated push-pull shaft links 42 suitably pivotally connected to the arms 40 and blade assemblies 30 near the upper portion of intermediate length portions L1.

The drive shaft has rigidly affixed at one end thereof a plate-like stop arm 44 (best shown in FIG. 6) that cooperates with a pair of adjustable bumper and support block assemblies 46, 48 that are suitably mounted to frame wall 16 to limit switch opening and switch closing rotation of the drive shaft 38. Assemblies 46, 48 each include a threaded sleeve 46*a* that extends through a threaded opening in support plate 46*b* that is welded to frame wall 16 and that is held in place by lock nut 46*c*. The shank of bolt 46*d* extends axially through sleeve 46*a* and carries cushioning washers 46*e*.

Rotation to the drive shaft 38 is imparted by the mechanical operator 36 that is mounted to frame wall 14. The mechanical operator 36, as noted previously, affords "quick make and break" engagement between the movable and stationary contacts.

The operative components of the mechanical operator 36 are mounted to the frame side wall 14 by support plate 200, and include an arming lever 202, a load release lever 204, two compression spring assemblies 206 and 208, and two locking and load release latches 210 and 212.

The arming lever 202 and the load release lever 204 comprise generally rectangularly-shaped plates and are disposed in a common plane adjacent and parallel to the plane of support plate 200. As best shown in FIG. 4, drive shaft 38 extends through journal openings in the frame side wall 14 and support plate 200 and is rigidly connected at the mid-point of the frame confronting face of the load release lever 204, so that the load release lever is thereby operatively connected therewith and is rotatable about the axis thereof. The arming lever 202 is mounted to rotate about an axis extending in spaced-apart parallel relation to the axis of rotation of the load release lever 204 and in a common plane therewith. In the illustrated embodiment the common plane of the foregoing axes of rotation is vertical with the arming lever 202 being located above the load release lever 204.

Compression spring assemblies 206 and 208 are each connected in uni-directional force transmitting relation between the arming and release levers and are respectively disposed on opposite sides of the common plane defined by the axes of rotation of the arming and release levers.

Each of the compression spring assemblies 206 and 208 includes an upper cylindrically-shaped mount 214, a lower cylindrically-shaped mount 216, an elongated guide rod 218 rigidly connected to the upper mount and projecting into and beyond a rod guide slide passage axially extending through the lower mount, and a compression spring 220 extending coaxially of the guide rod 218 between the upper and lower mounts 214, 216.

Figure 3:
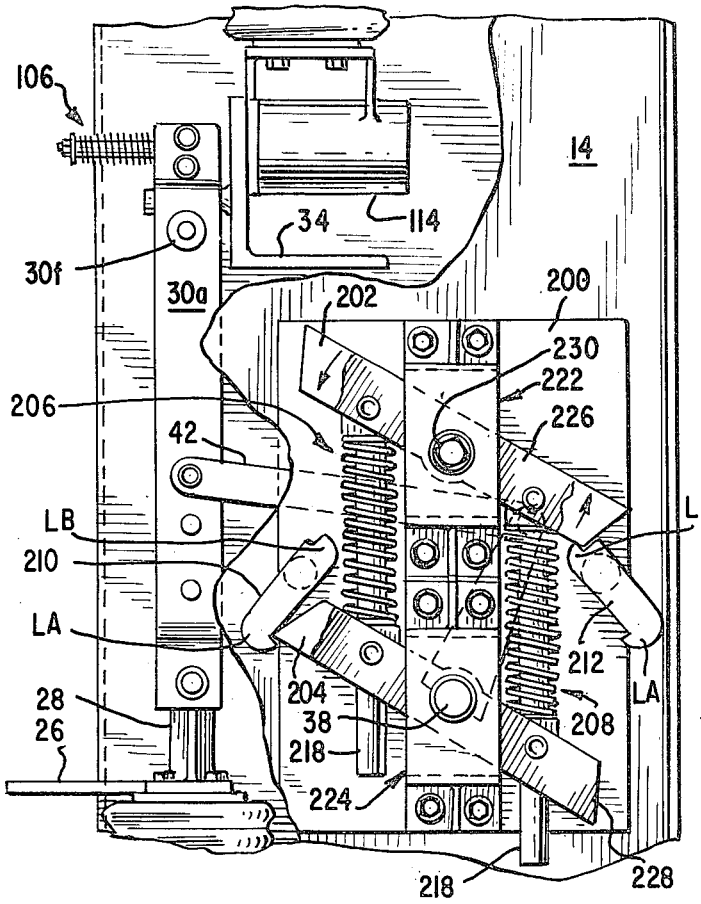
FIG. 3 is a side elevational view showing the mechanical operator and with portions of the frame broken away to better illustrate the drive linkage between the drive shaft and the blades, the operator being shown in the switch "closed" position.

A pair of generally channel-shaped brackets 222 and 224 are connected by bolts to the support plate with the bracket webbs W is spaced parallel relation to the support plate and with the mid-points of the webbs intersecting the axes of rotation of the arming and load release levers, so that the latter extend between the legs of the brackets 222 and 224. A pair of support plates 226 and 228 (which in the embodiment disclosed herein are fabricated identically to the arming and release levers) are pivotally mounted to the webbs of brackets 222 and 224, respectively, to rotate between the bracket legs. The upper and lower cylinder mounts 214 and 216 for each of the compression spring assemblies are pin mounted between the arming and release levers 202, 204 on the one hand, and the support plates 226, 228 on the other hand, so that the compression spring assemblies are disposed on the opposite sides of a plane defined by the axes of rotation of the arming and release levers 202 and 204. The above-noted latches 210, 212 as best shown in FIG. 3, each has opposed latch end portions LA and LB and is pivotally mounted to the main support frame 200 to rotate about a point between the end portions thereof. The latches 210, 212 are biased such that latch end portion LA of each latch is urged toward the load release lever 204. The biasing is accomplished in the embodiment disclosed herein by connecting pin P that extends through a guide slot S (see FIGS. 1 and 2) in the frame wall 14, each connecting pin P being connected to a biasing spring (not shown) affixed to the inside of frame wall 14. Completing the operator 36, a shaft 230 having a free end adapted to receive a handle (not shown) extends in journaled relation through the upper bracket 222 and is rigidly affixed to both the arming lever 202 and the corresponding support plate 226.

OPERATION

The operation of the air switch will now be described with the switch being in the "closed" position as best shown in FIGS. 1 and 3.

Figure 8:
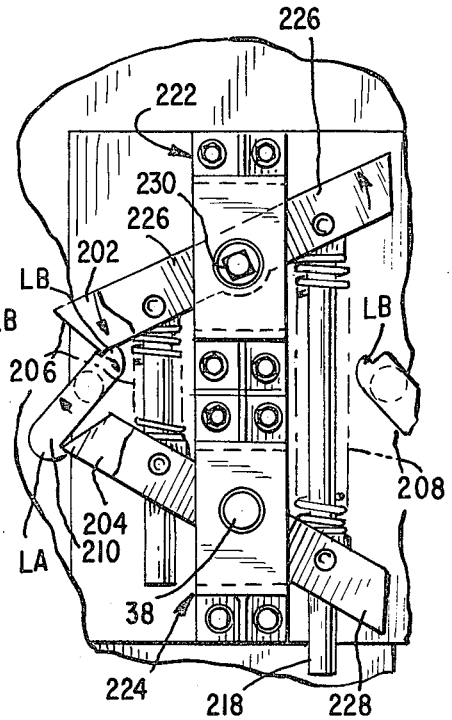
FIG. 8 is a view similar to FIG. 3 showing the mechanical operator in elevation with arming lever rotated into engagement with the left hand locking and load release latches just prior to disengagement thereof with the load release lever.
Figure 9:
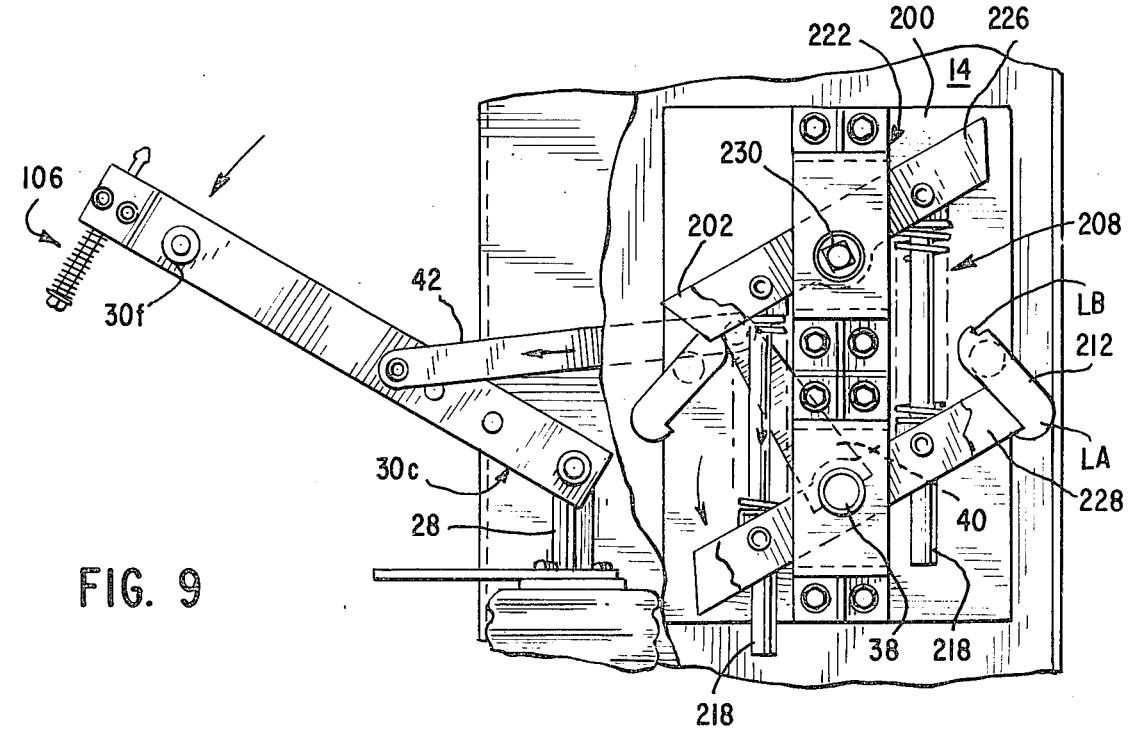
FIG. 9 is a view similar to FIG. 3 showing the operator in elevation following disengagement of the locking and load release latch with the load release lever and the resulting disengagement of the blade and contact assemblies.

With reference initially to FIGS. 1 and 3, to "open" the switch from the switch "closed" position illustrated, the operator positions a suitable handle (not shown) onto the free end of shaft 230 which, as noted above, is connected to the arming lever 202. The handle is rotated in a counterclockwise direction ("CCW") as indicated by the arrows, thereby rotating the arming lever 202 in the CCW direction. At this time, rotation of the load release lever 204 is prevented due to engagement thereof by the left hand latch 210. As a result, CCW rotation of the arming lever causes the left hand spring 220 to undergo compression as the corresponding spring guide shaft 218 begins downward motion through left hand lower cylinder mount 216. It will be noted that the right hand power spring does not undergo either compression or expansion at this time since the power springs are not affixed to the cylinder mounts. At a predetermined point during its CCW rotation, arming lever 202 makes contact with the left hand latch 210 as shown in FIG. 8. Further CCW rotation of the arming lever cause clockwise rotation of the latch, thereby freeing load release lever 204 for CCW rotation. Simultaneously, the left hand power spring releases its compressed load to the load release lever thereby initiating rotation thereof in the CCW direction, as shown in FIG. 9. As noted previously, load release lever 204 is fixed to drive shaft 38 so that the stored power spring load energy is directly relayed to drive shaft 28 via load release lever 204. Rotation of the drive shaft 38 in a CCW direction drives the blade assemblies open via the lever arms 40 and insulated push-pull shafts 42 as shown in FIG. 9. Blade assembly rotation is checked when the rotating stop plate 44 affixed to the drive shaft 38, greets the lower adjustable "open position" bumper and support block 48 (see FIG. 6). At this time, the right hand latch 212 locks into engagement with the load release lever which, in cooperation with the lower bumper and support block 48, locks the switch gear in the "open" position shown in FIG. 2.

To activate the switch back to the switch "closed" position, the aforementioned process is followed in the reverse direction utilizing the right hand power spring and latch.

The load break sequence, upon initiation of blade assembly rotation from the switch "closed" position, will now be described.

Figure 12:
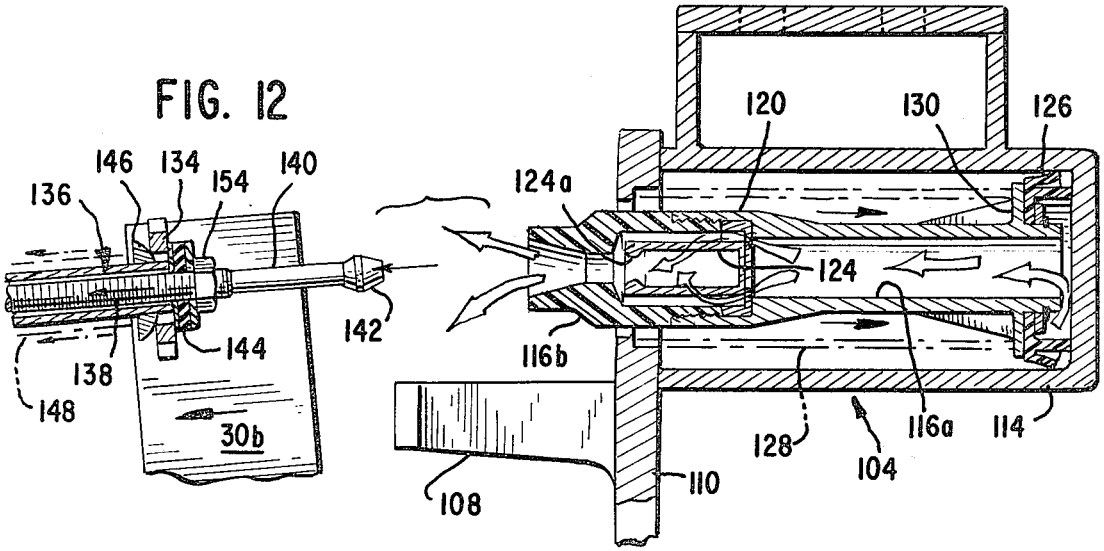
FIG. 12 is a fragmentary view similar to FIGS. 10 and 11 showing the probe assembly disengaged from the upper assembly and illustrating the compressed airflow through the puffer for disturbing any arc or ionized gas, thereby eliminating arcing tendencies.

With reference to FIGS. 10 through 12, as the blade assemblies begin moving toward their "open" position, probes 136, which are in mechanical interference fit engagement with the probe receptacles 124, begin to pull the puffers 116 through the cylinder chambers 114*a*. This action initiates compression of puffer springs 128 and probe springs 148. At this time, the main movable contacts 30*f* of the blade assemblies 30 disengage from the main stationary contacts 100, and the current flows from the blade assemblies 30 through the probe and puffer sub-assemblies 104, 106 and from the puffer springs 128 to the upper termination pads 34.

As the blade assemblies 30 continue to rotate, the puffer and probe springs 128, 148 completely compress and the probes 136 completely separate from the probe receptacles 124. The probe springs 148 then drive the probes 136 back to their original positions and the puffer springs drive the puffers 116 back into the cylinder chambers. The latter action creates a compressed air flow through the cylinder chambers and puffers due to the sealing action of the piston caps 126 against the chamber walls. This air flow is directed through and out the open end of the puffer sub-assemblies as shown by the arrows in FIG. 12, thus introducing a burst of cooler deionizing air that disturbs and disperses any arc or ionized gas, hence eliminating the natural arcing tendencies.

It will now be apparent that there has been disclosed an air switch which avoids the disadvantages of prior constructions and which achieves the foregoing objects. In this connection it should be understood that, while a specific preferred embodiment has been disclosed herein, various changes and variations may readily be made without departing from the spirit and scope of the appended claims.

What is claimed is:

1. In a load break switch having stationary and movable interengageable contact means, means including an axially rotatable drive shaft for driving the movable contact means between a switch closed position wherein the movable contact means and the stationary contact means are engaged and a switch opened position wherein the movable contact means and stationary means are disengaged, and mechanical operator means for imparting relatively short duration and high level rotational force to said drive shaft to thereby drive said movable contact means rapidly between the switch opened and closed positions, said operator means comprising:

an arming lever rotatable about a first axis;

a load release lever rotatable about a second axis and operatively connected to said drive shaft, said second axis being disposed in spaced parallel relation to said first axis and jointly therewith defining a plane;

first and second compression springs each connected in uni-directional force transmitting relation between the arming and release levers and respectively disposed on opposite sides of said plane, both said springs being substantially uncompressed upon said movable contact means being located at the switch closed and opened positions;

first latch means for locking said load release lever against rotation upon initiation of rotation of said arming lever in a first direction thereby effecting compression of the first of said compression springs, said first latch means being responsive to predetermined rotational travel of said arming lever in said first direction to release said load release lever and permit the same to rotate in a first direction under the action of the first of said compression springs, whereby said rotational force is applied to said drive shaft to drive the movable contact means from the switch closed position to the switch opened position; and second latch means for locking said load release lever against rotation upon initiation of rotation of said arming lever in a direction opposite said first direction thereby effecting compression of the second of said compression springs, said second latch means being responsive to predetermined rotational travel of said arming lever in said direction opposite said first direction to release said load release lever and thereby permit the same to rotate in a direction opposite said first direction under the action of the second of said compression springs, whereby said rotational force is applied to said drive shaft to drive the movable contact means from the switch opening position to the switch closed position.

2. In a load break switch having movable contact means interengageable with stationary contact means to open and close the switch, said movable contact means including a pair of elongated blades mounted to extend in parallel, spaced-apart, side-by-side relation, electrically conductive movable contact support means, and pivot means connecting the support means and the movable contact means, the improvement wherein said pivot means comprises end support means integral of said movable contact support, said end support means comprising a body having opposed side faces and axially bored to define a cylindrically shaped opening extending between said side faces, a cylindrically shaped shaft of highly conductive material journal mounted within said opening and extending beyond said opposed side faces, said shaft having a circumferential recessed portion to define a circumferential gap between the end support and the shaft within the opening, louvered contact band means circumferentially extending within said gap providing a multiplicity of contact points between shaft and end support, and means for securing the shaft firmly between the blades of the movable contact means.

3. In a load break switch having moveable contact means interengageable with stationary contact means to open and close the switch, said movable contact means including switch blade means, electrically conductive movable contact support means, and pivot means connecting the support means and the movable contact means, the improvement wherein said pivot means comprises end support means integral of said movable contact support, said end support means comprising a body having opposed side faces and axially bored to define a cylindrically shaped opening extending between said side faces, a cylindrically shaped shaft of highly conductive material journal mounted within said opening and extending beyond said opposed side faces, said shaft having a circumferential recessed portion to define a circumferential gap between the end support and the shaft within the opening, louvered contact band means circumferentially extending within said gap providing a multiplicity of contact points between the shaft and end support, and means for maintaining electrically conductive contact between said shaft and said switch blade means.

* * * * *

UNITED STATES PATENT AND TRADEMARK OFFICE

CERTIFICATE OF CORRECTION

PATENT NO. : 4,263,487

DATED : April 21, 1981

INVENTOR(S) : Clarence L. Welter, Stephen R. Riggens

It is certified that error appears in the above-identified patent and that said Letters Patent are hereby corrected as shown below:

Column 4, line 62, delete "116(d)" and substitute therefor -- 116(b) --;

Claim 1, line 27, delete "opening" and substitute therefor -- opened --.

Signed and Sealed this

*Seventh* Day of *July 1981*

[SEAL]

*Attest:*

RENE D. TEGTMEYER

*Attesting Officer*

*Acting Commissioner of Patents and Trademarks*